US007331872B1

(12) United States Patent
Parsons

(10) Patent No.: US 7,331,872 B1
(45) Date of Patent: Feb. 19, 2008

(54) BATON SCABBARD BELT PLATE

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 11/342,988

(22) Filed: Jan. 30, 2006

(51) Int. Cl.
*A45F 5/00* (2006.01)
*F41C 33/04* (2006.01)

(52) U.S. Cl. ..... 463/47.2; 224/195; 224/197; 224/914

(58) Field of Classification Search ..... 463/47.2, 463/47.7; 224/195, 240, 904, 912, 914, 915, 224/931
See application file for complete search history.

(56) References Cited

U.S. PATENT DOCUMENTS 4,662,552 A * 5/1987 Uyehara ..... 224/251
5,421,497 A * 6/1995 Gilmore ..... 224/198
5,449,104 A * 9/1995 Parsons et al. ..... 224/245
5,544,794 A * 8/1996 Nichols ..... 224/667
5,551,610 A * 9/1996 Clifton, Jr. ..... 224/197
5,551,611 A * 9/1996 Gilmore ..... 224/198
5,839,630 A * 11/1998 Dunstan et al. ..... 224/197
6,059,157 A * 5/2000 Parsons et al. ..... 224/251
6,189,751 B1 * 2/2001 Tserng ..... 224/244
6,575,343 B2 * 6/2003 Mossman ..... 224/198

* cited by examiner

*Primary Examiner*—William M. Pierce
(74) *Attorney, Agent, or Firm*—Welsh & Katz, Ltd

(57) ABSTRACT

A scabbard and method of using, for a baton used by security and police-personnel is provided. The scabbard includes a baton holding element and means to attach the scabbard to a user's belt. The attachment means permits the user to adjust the angle at which the baton is held and permits the angle to be fixed so that the user need not readjust the position each time that the scabbard is worn. The scabbard also can adjusted for use with belts of different widths; and uses deep socket hex screws that provide greater strength in connection and little interference with clothing so that damage does not occur. The method describes the manner in which the provided scabbard can be used.

26 Claims, 8 Drawing Sheets

BATON SCABBARD BELT PLATE

FIELD OF THE INVENTION

This invention is generally related to a baton carrier or scabbard for holding an expandable baton on the belt of law enforcement, military or security personnel as part of the official issue equipment. More particularly, the present invention is specifically directed to an adjustable baton carrier for holstering an expandable baton in either the expanded or retracted condition interchangeably for use by both right and left handed users and fixable in a position for repeated use.

BACKGROUND OF THE INVENTION

Expandable batons are used primarily by law enforcement officers, military and security personnel. Typically expandable batons have a cylindrical handle and one or more telescoping cylindrical shafts that can be nested inside the larger handle when the baton is retracted. While the retracted baton is typically of a manageable size, it can still be ungainly, especially when hung from the belt of the user and when the user is seated, such as in a car.

Batons come in various sizes. In particular, the diameter of the baton handle and the diameter of the telescoping shafts can vary. Usually a blunt, enlarged tip is located at the outer end of the innermost telescoping shaft of the expanded baton, however, some new batons having a smaller, or linear tip, are being used in a number of countries.

Baton carriers, or scabbards, are typically designed to either be clipped to the belt or threaded onto the belt of a person carrying a baton. By attaching the scabbard to the belt, in either manner, the user is provided a sheath for stowing the baton in an at-ready position. A baton carrier should be designed so that a baton cannot be inadvertently released from the carrier, or be taken by an adversary. It is thus important that baton carriers positively secure the baton within the carrier, while at the same time providing for a quick release of the baton for authorized use. Further, the baton should be placed near the users stronger, or chosen, hand such that the user is afforded appropriate control of the baton without having to take time to switch hands once the baton is unsheathed, therefore it is important that a baton holder be capable of placement either at the user's right or left side as needed and be usable in either position.

In prior art scabbards, adjustments to the angle of the carrier, relative to the user's waist, needed the complete disassembly and reassembly of the device. As a result, users would make a preliminary adjustment and then leave the device in that position rather than go to the trouble to disassemble and reassemble for minor corrections. Devices of the prior art, therefore, were often not adjusted further due to the difficulties involved.

In most circumstances it is convenient for the baton to be retracted because a retracted baton is compact and permits generally unrestricted movement by the wearer. However, in certain applications, such as riot control operations and the like, it may be preferred to stow the baton in the expanded position. Also, it may be impractical to collapse the baton particularly where a hard surface is not available for striking the required sharp axial blow, such as in grassy fields or in marine operations such as in inflatable boats. Under these and similar circumstances, it would be desirable to be able to properly holster or stow the baton and to quickly withdraw the baton from the carrier both when it is expanded and when it is retracted, utilizing a single carrier. It is preferable that the sheath portion of the scabbard be movable such that, at the preference of the wearer, the sheath can be worn parallel to the legs or at an angle to the leg (pivoted about the waist) so that the baton extends to behind the user to allow freer movement of the user, and a more easy, natural, withdrawal from the scabbard. Further, it would also be advantageous to permit the user to pivot the baton so that it is carried forward of the leg, for situations, for example, where a baton, or other elongated implement, is used to hold a mirror or other object being used in aid of security services. It would also be preferable to allow a user to set, on the scabbard, an angle at which the baton is carried comfortably or which is advantageous for the particular use, so that when the scabbard is put on it is pre-set to the users preferred position.

Since all expandable batons do not have the same dimensions, it would also be desirable that a baton carrier be readily adapted to accommodate any of a number of various configurations.

SUMMARY OF THE INVENTION

A baton carrier for use in combination with an expandable baton is provided. The baton carrier adapted for holding an expandable baton in both open, extended and a closed retracted conditions when the holder is secured to a user's person. The baton carrier comprising a baton holder of the types manufactured by Armament Systems and Procedures, of Appleton, Wis., assignee of the present application. Typically, baton holders comprise a carrier having an elongated generally cylindrical interior wall or elongated interior chamber for engaging and holding the handle of the expandable baton substantially along a longitudinal axis of the interior chamber. Such holders often comprise an open top, for ease in placement of the baton; but other holders include a flap or other closing member to protect the baton insitu. Such holders also can have an open, substantially open, substantially closed or closed bottom, all of which are available at the preference of the user.

The baton carrier further comprises an adjustable attachment assembly for securing the holder on the belt of a user. In a preferred embodiment, the attachment assembly is fixedly adjustable to one or more desired positions, and advantageously adjustable for both right and left handed users. In a preferred embodiment, the attachment means includes fasteners for fixing the attachment means in an adjusted position and in one embodiment the fasteners comprise a screw having a hexagonal-type drive opening, the opening being created such that the opening advances from the head of the fastener through to the interior of the shaft. Such screws providing a strengthened connection, permitting the use of light-weight plastic that tends to not pull apart under the great torque that can be developed. Further, the lower profile screws tend to protect against the marring or destruction of fabric to which it can contact (such at cloth or leather belts and clothing including pants or trousers).

In a preferred embodiment of the present invention, additional adjustments to the position of the baton holder to the attachment assembly can be made by merely loosening the screws and swiveling the holder and assembly to a desired position and then retightening the screws.

The baton carrier of one embodiment further has an attachment assembly that is curved to accommodate the curve of the waist of the user. The attachment assembly is also constructed having a tapering profile such that the top of the baton holder, and therefore the baton when in place in the holder, is angled in towards the user's body. Such a profile makes the baton more easily concealed.

Further, one embodiment of the baton carrier of the present invention includes means allowing the assembly to fit belts of varying widths. In a preferred embodiment the adjustment means, to allow a fit to belts of varying widths, is a position bar on a slider. The attachment assembly, of a preferred embodiment, includes one or more belt openings and one positioning bar in each opening, the positioning bars being adjustable so as to hold the assembly in position on a belt. The positioning bar or bars are positioned and adjustable using a fastener therewithin. The invention further includes the method of adjusting the baton carrier to fit the desired conditions.

The baton carrier further, is manufactured having a holder, integrated into the back area, for holding a tool for making necessary or desired adjustments. The back is created with a location fur inserting and storing a hex or Allen-type tool safely therein. As a result, the user can, when needed, retrieve the tool and adjust the unit without having to secure a separate tool. In a preferred embodiment, the tool is removed from the case using another of the typical user's tools, that is the key for a handcuff (also used by security and police personnel) or other small pointed object carried by an officer.

A baton carrier made in accordance with the present invention provides a practical solution for both positively securing and easily withdrawing an expandable baton when it is either retracted or expanded and through its adjustment means permits the scabbard to be set and kept at a desired angle as desired by the user. Such a setting and fixing of the scabbard and baton holder permits the user to set a desired angle and subsequently remove the holder in its set position. In this manner the user can pick up the stored baton holder at any time and attach it to a belt in its set desired position for instant availability of a baton (or other device) at a desired angle.

In addition, the carrier is readily adapted to carry any of a variety of batons on a variety of belts at appropriate angles for use and storage. It is a further feature of the invention that the carrier can be locked in position on the belt, thus minimizing any tendency of the carrier to slip relative to the belt during use. The locking means is designed so that a firm grip is provided at both ends of the carrier when even a belt of inconsistent thickness is used, as the gripping means at either end of the carrier can be adjusted individually to the belt thickness. The locking means in a preferred embodiment each include a tab which is designed to fit into and ride a groove created on the plate. In this manner the belt adjusters are kept in alignment on the plate as they move up and down the groove, or track.

In the preferred embodiment of the invention, the carrier is designed to permit a retracted baton to be withdrawn axially from the carrier in the normal, well-known manner in much the same way as a knife is drawn from its sheath, while at the same time allowing for either axial or axial/radial removal of a fully extended baton. In one embodiment, the carrier has an open side wall which is specifically designed so that it cannot spread sufficiently to permit lateral withdrawal of the enlarged handle but will spread sufficiently to permit the telescoping sections to pass. Specifically, the carrier of that embodiment is designed to spread at its side by using the expanded baton as leverage in order to permit radial or lateral removal of the expanded baton. It will be understood that the carrier can also be made without such an opening, utilizing well know carrier portions presently available with the belt attachment means of the present invention.

The invention includes several other features that are apparent from the detailed description. Although the invention is particularly useful for carrying an expandable baton, it may also be adapted for carrying other equipment needed by law enforcement officials in the performance of their duties, such as, by way of example, flashlights or mace canisters or the like.

DETAILED DESCRIPTION OF THE PREFERRED EMBODIMENT

Figure 1:
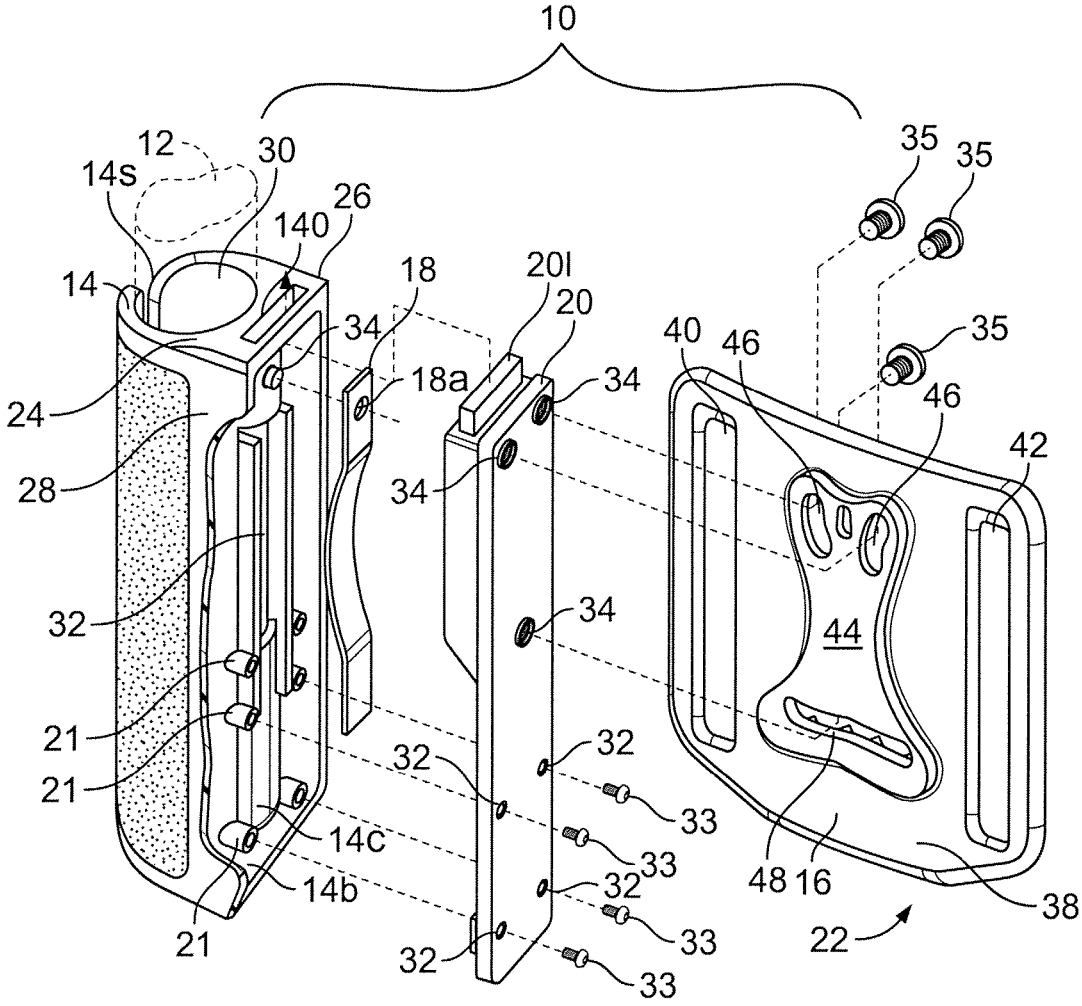
FIG. 1 is an exploded perspective view of a baton carrier showing a baton holder, an attachment assembly and various components of the carrier according to the invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description of the Illustrative Embodiment") relates to a requirement of the United States Patent Office, and should not be found to limit the subject matter disclosed herein.

Referring to FIG. 1, a baton scabbard 10 shown in an exploded view so that the major components can be easily identified. As shown in FIG. 1 the scabbard 10 is designed to hold a baton 12 (shown in phantom), within a baton holder 14. Baton scabbard 10 is generally comprised of the following parts: a baton holder 14, an attachment member 16 for attaching the carrier 10 to a belt (not shown), a friction spring 18, a back cover 20 for containing the friction spring in a pressing relationship with a baton 12 located in the baton holder 14; and a belt receiving structure 22, which will be discussed in greater detail below. In the illustrative embodiment, the baton holder 14, back cover 20 and belt receiving structure 22 are constructed of light weight strong materials, such as plastics. It will be understood by persons having ordinary skill in the art that other strong and light weight materials can be utilized in the manufacture of a baton scabbard without departing from the novel scope of the present invention.

Figure 8:
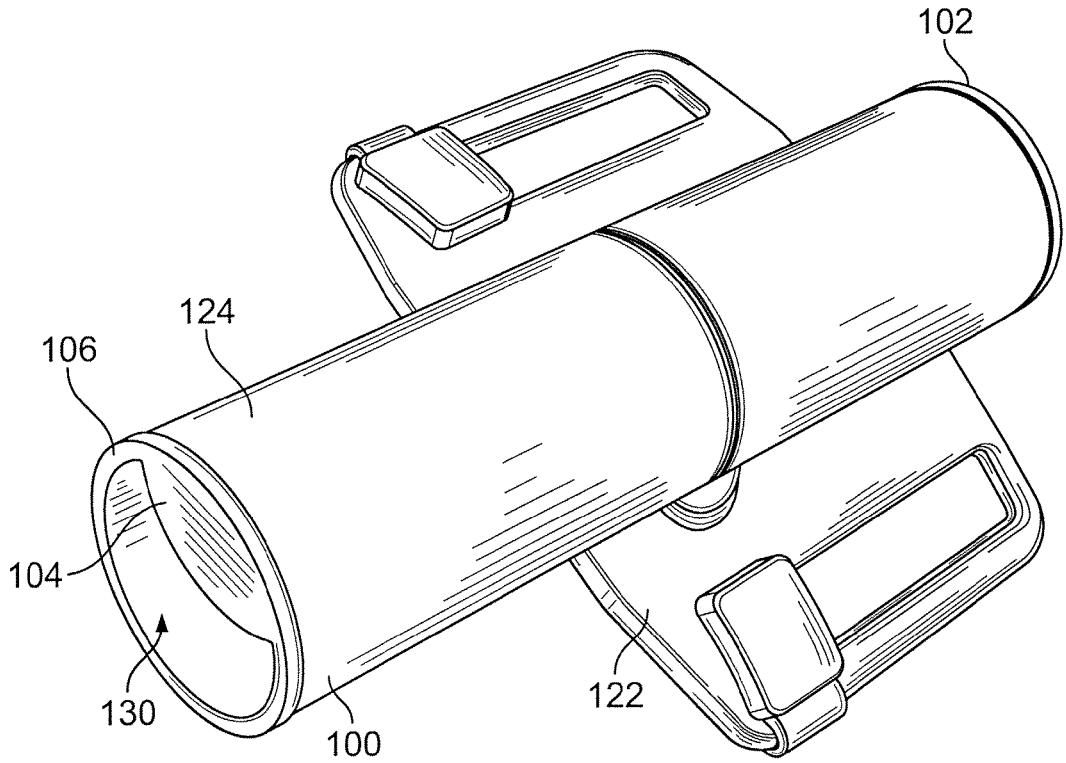
FIG. 8 is a perspective view of another embodiment of the baton carrier of the present invention.

The individual elements and assembly of the baton carrier 10 are shown in greater detail throughout the drawings, as will be explained. The baton holder 14, which is a type referred to as a Sidebreak baton holder by the manufacturer, Armament Systems and Procedures, Inc., of Appleton, Wis., the assignee of the present application, consists of a generally cylindrical wall 24 forming an interior chamber or passage 30 in which the baton 12 is placed. A Federal baton holder is shown in FIG. 8 and will be described in more detail below.

As shown in FIG. 1, the generally cylindrical wall 24 comprises two wall portions 26 and 28 that extend tangentially from the cylindrical wall 24 in the direction of the back cover 20. At a front end of baton holder 14, wall portions 26 and 28 terminate in proximity to each other to form a longitudinal slit 14*s*, which will be discussed in greater detail below. The back cover 20 is shown having openings 32 for receiving screws 33 for attachment to baton holder 14 as well as openings 34 for attachment to belt receiving structure 22, using screws 35. Screws 35, which are illustrated as deep hex socket head screws, will be discussed in greater detail below. Back cover 20 further includes an attachment tab 201 for ensuring that the back cover, and any attached belt connection assembly (such as belt receiving structure 22) is securely fastened to the baton holder 14.

Referring to baton holder 14, it will be seen that the holder 14 comprises a back portion 14*b*, which includes a cavity 14*c*, into which back cover 20 is fitted. Cavity 14*c* comprises structures into which back cover 20 can be secured, including threaded screw receiving means 21; as well as an opening 32, through which friction spring 18 can be disposed. The spring 18 may have a continuously curved center portion (FIGS. 1 and 4) that engages and secures the baton 12 within inner chamber 30 of the scabbard 10. The continuously curved center portion has been found to allow much easier insertion and removal of the baton from scabbard 10. A post 34 in cavity 14*c* may engage an aperture 18*a* within the leaf spring 18 to hold the spring 18 in the proper, operational position.

Figure 4:
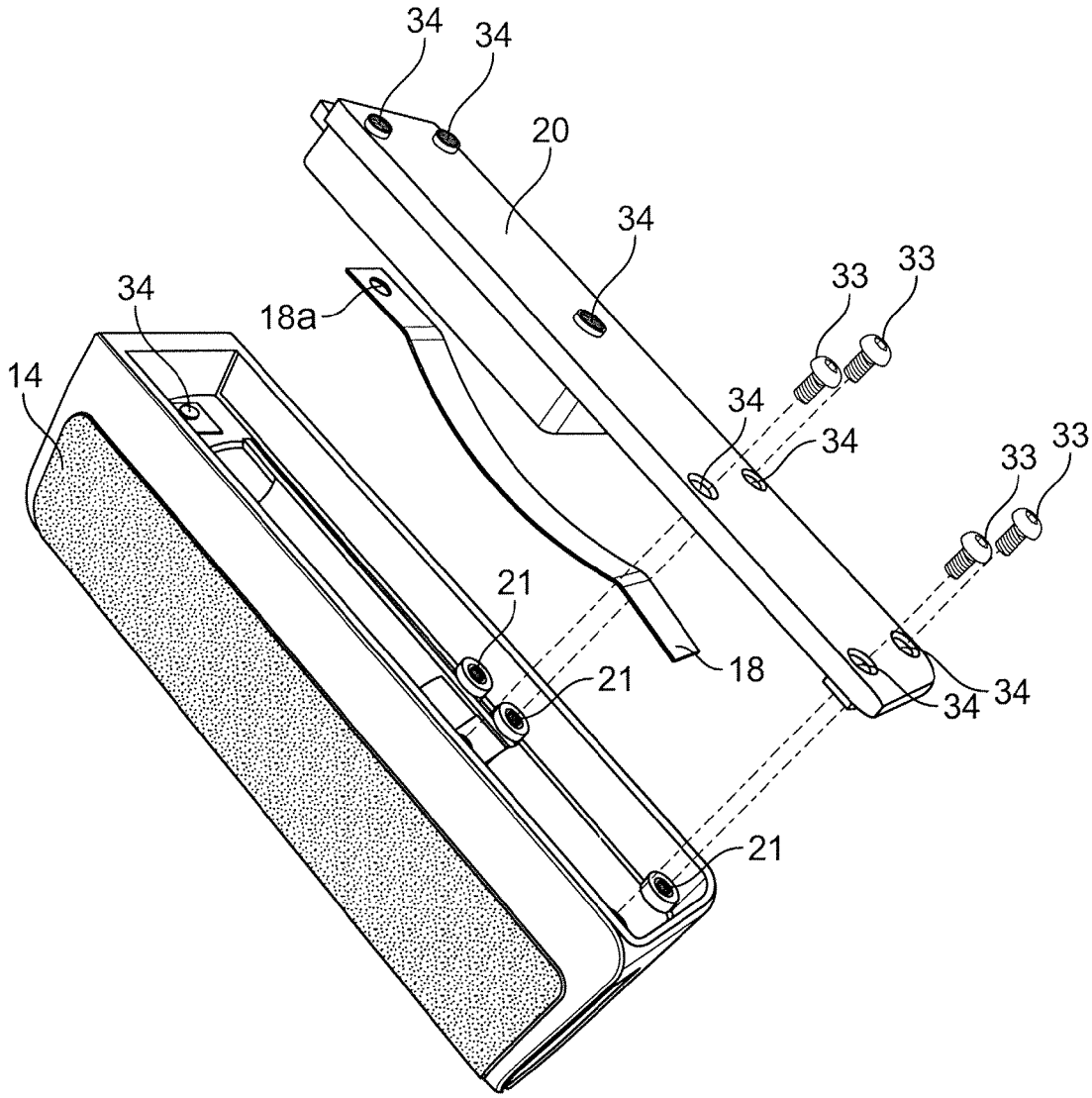
FIG. 4 is an exploded perspective view of the baton carrier alone.

In the assembly of the baton holder 14 of the present invention, as shown in FIGS. 1 and 4, spring 18 is secured within cavity 14*c* and back cover 20 is attached thereto. Back cover 20 is attached to baton holder 14 by insertion of tab 201 into its corresponding opening 14*o* in baton holder 14 and securing the lower portion of back cover 20 to baton holder 14 using screws 33 and threaded openings 21. It will be understood by persons having skill in the art that back cover 20, spring 18 and baton holder 14 can be assembled together using other well known means, including friction fit and/or adhesive means, as well as by using other types of fasteners, without departing from the novel scope of the present invention.

A belt receiving structure 22 is shown in FIG. 1 in exploded relation to the other parts of the baton scabbard 10 of the present invention. In the illustrative embodiment, belt receiving structure 22 comprises a generally horizontally oriented plate 38 having a first belt opening 40 and second belt opening 42 spaced apart and near the left and right edges of plate 38. Plate 38, in a preferred embodiment is configured to have a gentle curvature such that a comfortable placement of the device of the present invention at the waist of the user is achieved.

Figure 3:
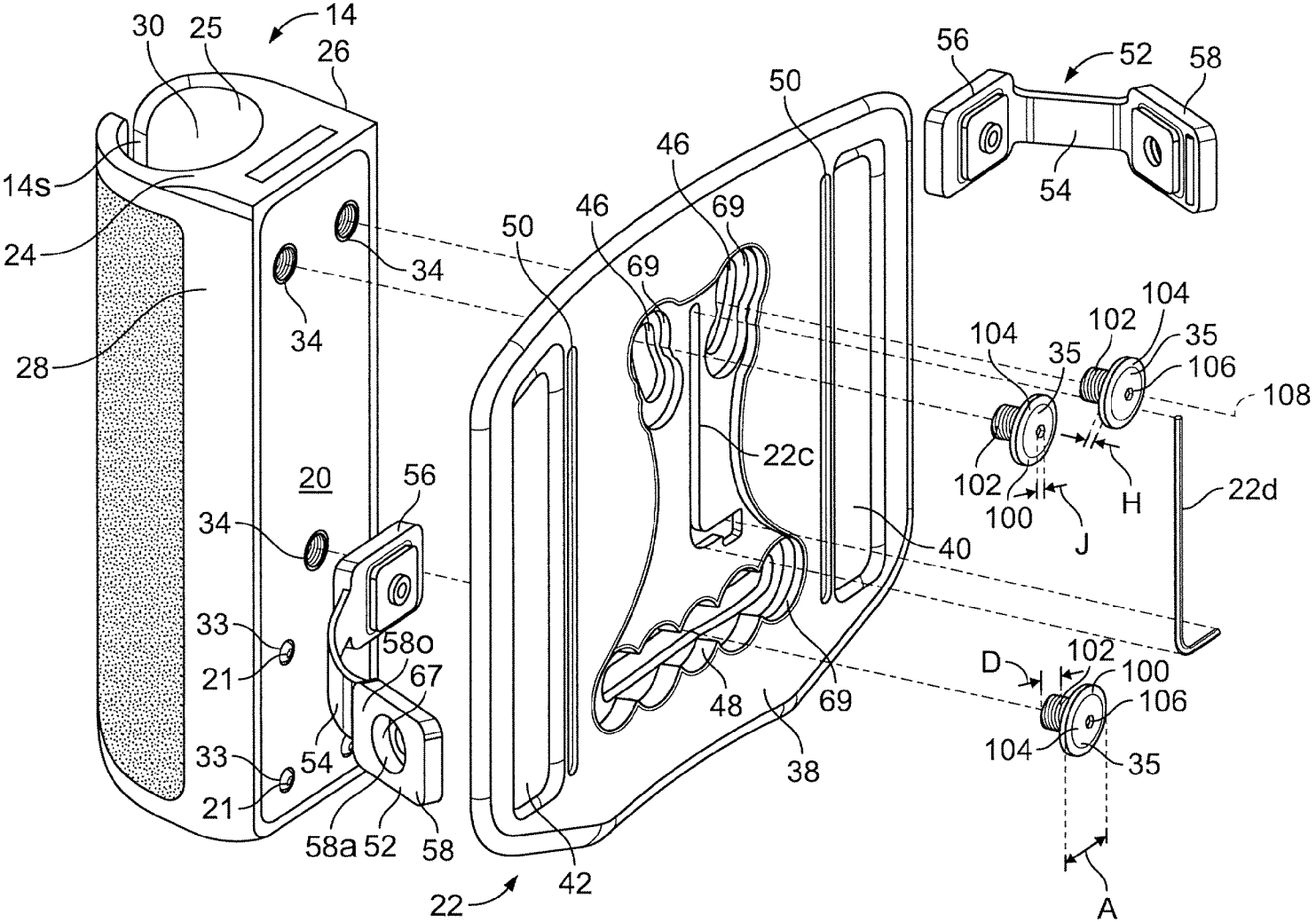
FIG. 3 is an exploded perspective view of the baton carrier and attachment assembly of FIG. 1.

Plate 38 further comprises an attachment and adjustment structure 44 generally centered in the plane of plate 38. In the illustrative embodiment, adjustment structure 44, as shown in FIGS. 1 and 3, includes a first and second upper screw hold structures 46 and a lower screw hold structure 48. Screw hold structures 46 and 48 are constructed so as to permit the secure attachment of belt receiving structure 22 to baton holder 14. Further, as shown in the figures, the configuration of screw hold structures 46 and 48 permit the user to adjust the relative angles of the baton holder 14 to the belt receiving structure 22 such that a comfortable position for holding a baton at the user's waist can be achieved and fixed; such that the user need fix an appropriate position once and then have a comfortable baton position whenever the baton scabbard 10 is used. The adjustment of baton holder 14 and belt receiving structure 22 will be discussed in greater detail below.

Figure 2:
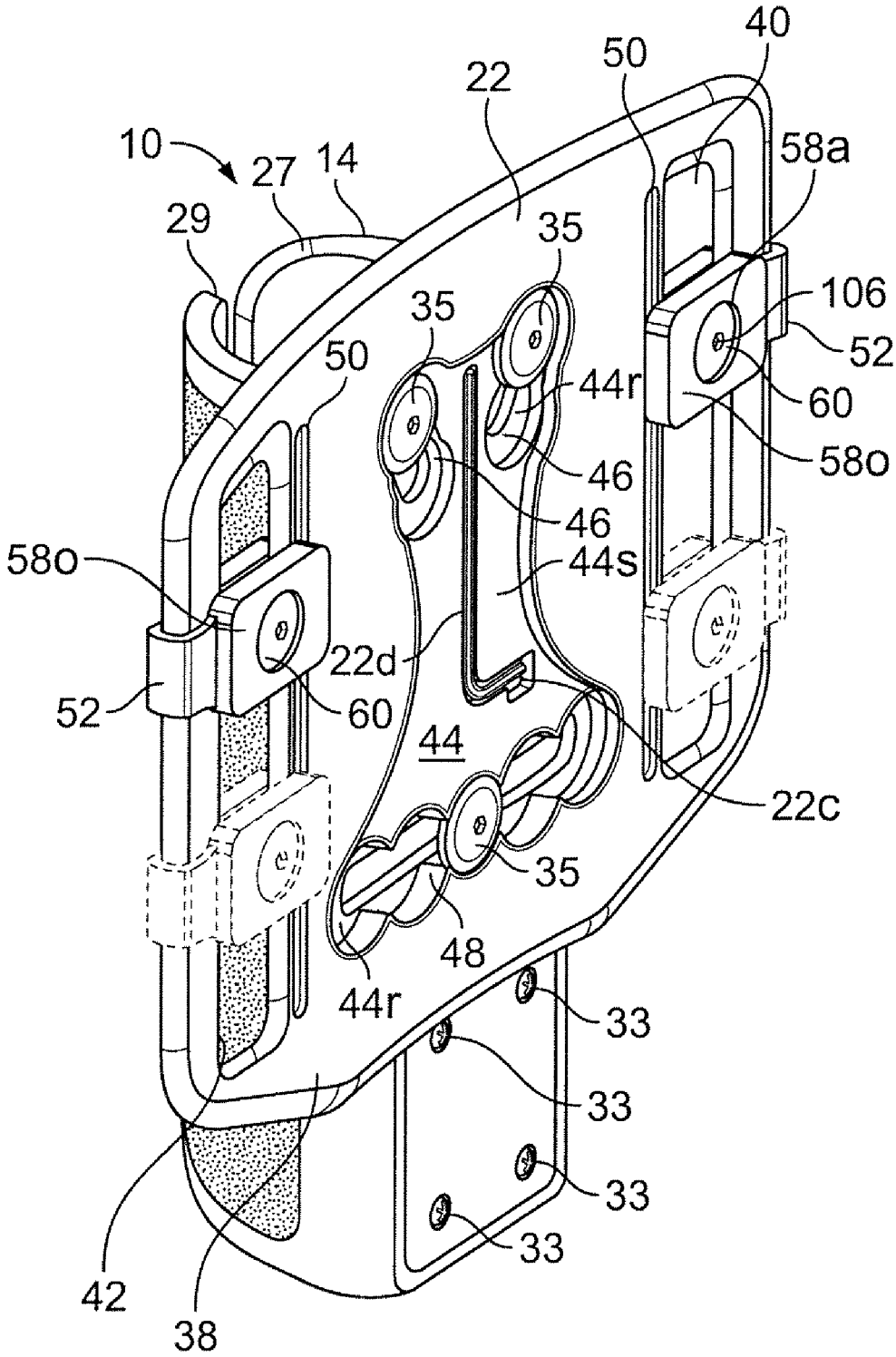
FIG. 2 is a rear perspective view of the baton carrier of FIG. 1, showing a first position and second position (in phantom) of the belt loop size adjustment means of the device of the present invention.

Belt receiving structure 22 further comprises a first and second slide track 50, each located adjacent the interior wall of belt openings 40 and 42 on plate 38, as shown in FIGS. 2 and 3. Slide tracks 50 are shallow grooves formed in plate 38 and provide means to permit adjustable belt slides 52 to be positioned as needed and adjusted as desired. It will be seen, in FIG. 2, that slides 52 can be moved relative to belt openings 40 and 42, such that a user of the present invention, can adjust the device to better fit the user's trouser belt. Adjustment for belt width, thereby, includes an infinite number of positions using slides 52 as well as the complete removal of slides 52 for use with wide belts. While slide track 50 has been shown as a shallow groove, it will be understood by persons having ordinary skill in the art that track 50 could also be configured as a raised groove, with a corresponding structure in slides 52, without departing from the novel scope of the present invention.

In the illustrative embodiment, slides 52 comprise a strip 54 of flexible material having a first head 56 and a second head 58 at either end of strip 54. First head 56, as illustrated, comprises means to secure a threaded fastener, such as screw 60, which is received in second head 58. In the use of slides 52, strip 54 is wrapped about the outer periphery of plate 38 so that first head 56 is held within one of belt openings 40 and 42 on the distal side of plate 38, and second head 58 mates up to head 56 from the proximal side of plate 38. Screw 60 can then be threaded though head 58 and into the threaded receptacle in head 56 and tightened. A tab 58*t*, can be provided on head 58 such that when attached to plate 38, tab 58*t* rides within slide track 50 so as to keep slides 52 in alignment as they move up and down the length of the plate 38. When screw 60 is tightened, slide 52 is fixed in position and when screw 60 is loosened, the user may adjust the position of slide 52 along openings 40 or 42, to accommodate the user's belt width.

Head 58, in the illustrative embodiment, has a countersunk opening 58*a* such that the head of screw 60 can be held below the outer surface 58*o* of second head 58, thereby protecting the fabric of the user's clothing from contact with the screw head. In a preferred embodiment, screw 60 is a deep socket hex type screw, which will be described in greater detail below.

In the use of the scabbard 10 of the present invention, adjustments to the angle at which the baton holder 14 is held with respect to the belt receiving structure are varied and can be fixed at a desired or comfortable position so that further readjustment need not be made. As such the user of the device of the present invention need set the desired angle once and have it pre-set for each use subsequent to the setting. The rapid placement of the baton holder 14 on a belt is thus facilitated, especially, for example, the security or police officer that only occasionally needs to place a baton on his belt but prefers that the baton hang a certain way from the belt.

Figure 5:
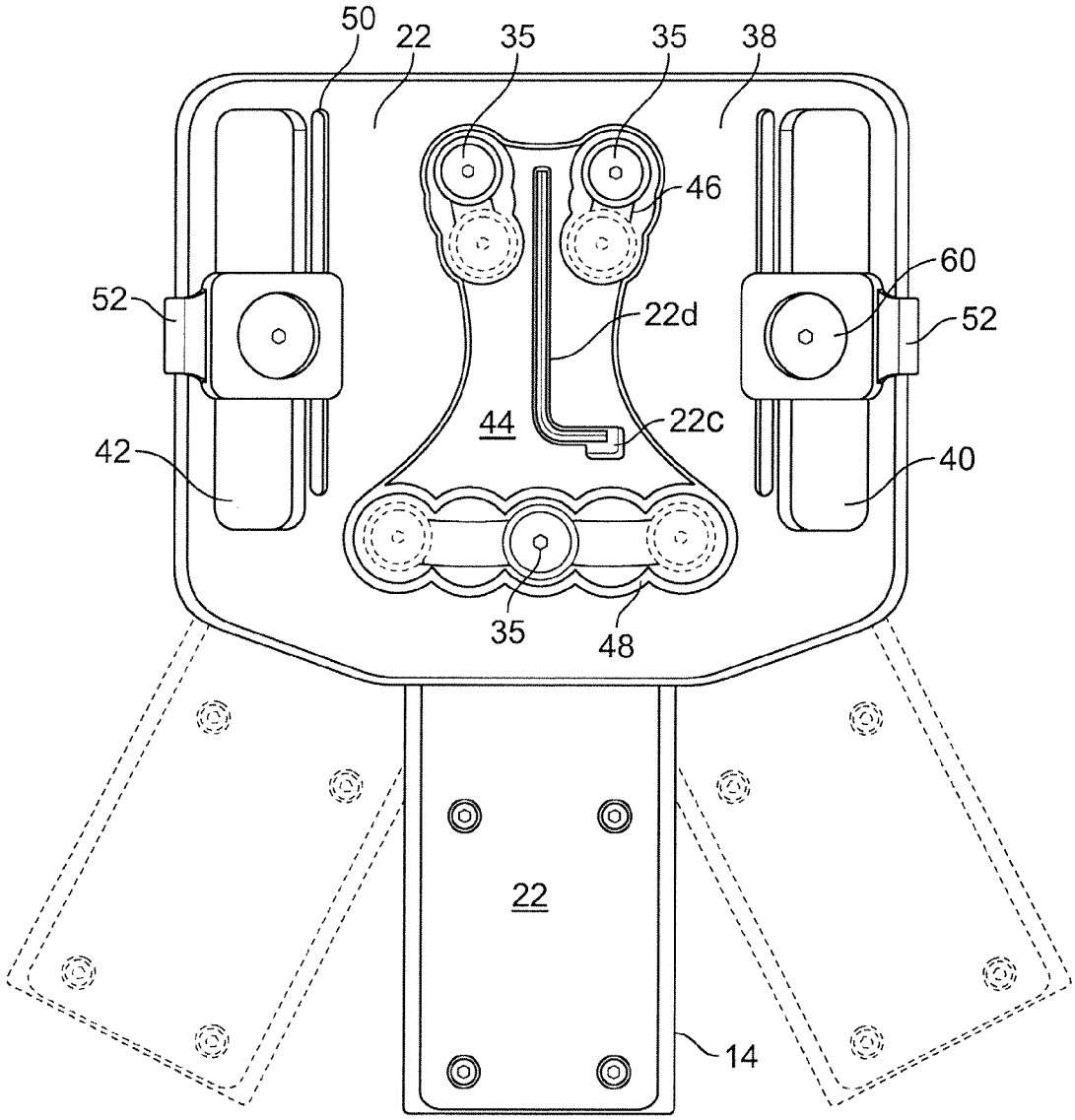
FIG. 5 is a rear plan view of one embodiment of the present invention, showing some of the positions (in phantom) to which the baton carrier and attachment means can be adjusted.

As demonstrated in FIG. 5, which for clarity shows only a few of the five available adjustments to the scabbard of the present invention, depending on the placement of screws 35 in screw hold structures 46 and 48 baton holder 14 can be held at a number of desired angles. The angles are created by loosening screws 35 and putting a desired location of the hold structures 46 and 48 over the holding structures 34 and tightening the screws 35 therein. Moreover, smaller adjustments to the angle of the carrier with respect to the belt receiving structure can be made by merely loosening screws 35 such that the head of the screw rises above the inner surface 44*s* of adjustment structure 44, swiveling plate 39 to the desired position, within the radius of room provide by the lower rim 44*r* of adjustment structure 44 and then retightening the screws 35. In other embodiments such adjustments can be facilitated by removing the serrations 48*s* from screw hold structure 48 and including separate serrations within structure 48 closer to the base of plate 38.

It will be seen that a number of adjusted configurations, for both left and right handed users, are available. It will also be seen, in FIG. 5, that the device of the present invention can be used with belts of a variety of different widths. It will be understood by persons having ordinary skill in the art, that while the illustrative embodiment demonstrates a number of available positions, a device permitting more or fewer positions could be made without departing from the novel scope of the present invention. Further, persons having ordinary skill in the art will see that while three setting screws are shown and described a minimum of two screws could be used to achieve similar results and the use of more screws and set locations can be provided without departing from the novel scope of the present invention.

In the illustrative embodiment of the device, which uses a number of deep hex socket head type screws, such as screws 35 and screws 60, the belt receiving structure 22 includes a hex screw driver 22*d* and defines a compartment 22*c* for storing the driver. Socket head screws are specially adapted for support structures, such as the baton scabbard 10 and similar applications. As noted above, the belt clip mounting plate 22 may be fabricated of plastic. The plastic material of the belt clip mounting plate 22 can represent a relatively soft material that must be mounted to a substrate (i.e., the back cover 20). The relative softness of the plastic causes a situation where a conventional metal screw head could easily pull through the surrounding plastic of the apertures 34 in back cover 20. Alternatively, if the screws 35, 60 were to be tightened too much, the threaded holders 34, 56 could pull free of the plastic material in which they are embedded. In order to avoid these problems, the socket head screws 35, 60 are provided with a number of distinguishing features. Applicant incorporates, herein by reference as thought it had been set forth in detail here, its co-pending patent application, U.S. patent application Ser. No. 11/258,506, filed Oct. 25, 2005, wherein the use of screws of this type are explained in greater detail.

FIG. 3 shows a side view of the socket head screws 35. As shown in FIG. 3, the screws 35 include a head portion 100 and a shaft (threaded portion) 102. The head portion 100 may be provided with a relatively large socket head 104. Relatively large, in this context, means that the diameter A of the head 104 is at least twice as large as a diameter D of the shaft 102. In one preferred embodiment, the diameter A of the head 104 is at least three times the diameter D of the shaft 102.

In addition to having a relatively large diameter head 104, the head 104 also has a depth H measured along a predominant (longitudinal) axis 108 of the screw 35 that is relatively thin. A relatively thin head depth means that the depth of the head H is less than 75% of the diameter D of the shaft 102.

The use of screws 35, 60 with a relatively large head diameter allows for the use of a larger shaft 102 (as measured by a diameter D, FIG. 3) than would otherwise be possible without the risk of pull-out. In order to further optimize the use of larger diameter screw portions 102, the screw openings, or apertures, 46, 48, 58*a* may be provided with recesses 67, 69 (respectively). The recesses 67 are provided with a diameter slightly larger than the diameter A of the screw head 104 and with a depth that is slightly greater than a depth H of the screw head 104. The result is that the heads 104 of the screws 35, 60 do not protrude out of the recesses 67 thereby preventing interference of the heads 104 with clothing, lessening chance of damage to clothing.

For a number of reasons (discussed below), the screws 35, 60 can also be provided with a relatively small hex (Allen-type) wrench aperture 106. A relatively small wrench aperture 106 means that a diameter J (FIG. 3) of the aperture 106 is less than 75% of the diameter D of the screw portion (shaft) 102.

It should be noted that because of the relatively thin depth H of the screw head 104, the aperture 106 extends through the head portion 100 into a portion of the shaft 102 where the shaft 102 abuts the head portion 100. More specifically, the depth of the recess 106 exceeds the screw head depth H. Such a depth may be determined by squaring a diameter D of the screw portion 108 and dividing by two times the diameter J of the recess 106. A proportionality factor may also be applied to the result to accommodate the relative hardness of the screws 35, 60.

The relatively small diameter J of the recess 106 may be used in combination with the depth of the recess 106 to limit the torque that may be applied to the screw 35, 60. In this regard, the diameter J and the depth of the recess may be controlled to allow the Allen-type wrench to break before the threaded members 34, 56 pull out of the plastic holding them in place.

In general, the diameter J of the wrench recess 106 can be a consideration in choosing the depth H of the screw head 104. It should be noted in this regard that if a conventional wrench size aperture were chosen based upon the diameter D of the shaft 102, then the thickness of the intervening wall that connects the head portion 100 and shaft 102 would not be of sufficient thickness and strength to resist shearing forces and failure. In accordance with illustrated embodiments, a single relatively small wrench diameter 22*d* is selected to accommodate all of the screws 35, 60 and 33 within the scabbard 10 based upon the loading of the screws. The depth T of the recess 106 may be adjusted according to the force on the screws 35, 60 and 33 and the requirement that the Allen-type wrench fail before damage occurs to the screw head recess 106. In general, the hex wrench 22*d* within the recess 22*c* is provided to accommodate that diameter J chosen for the screws 35, 60 and 33.

Figure 6:
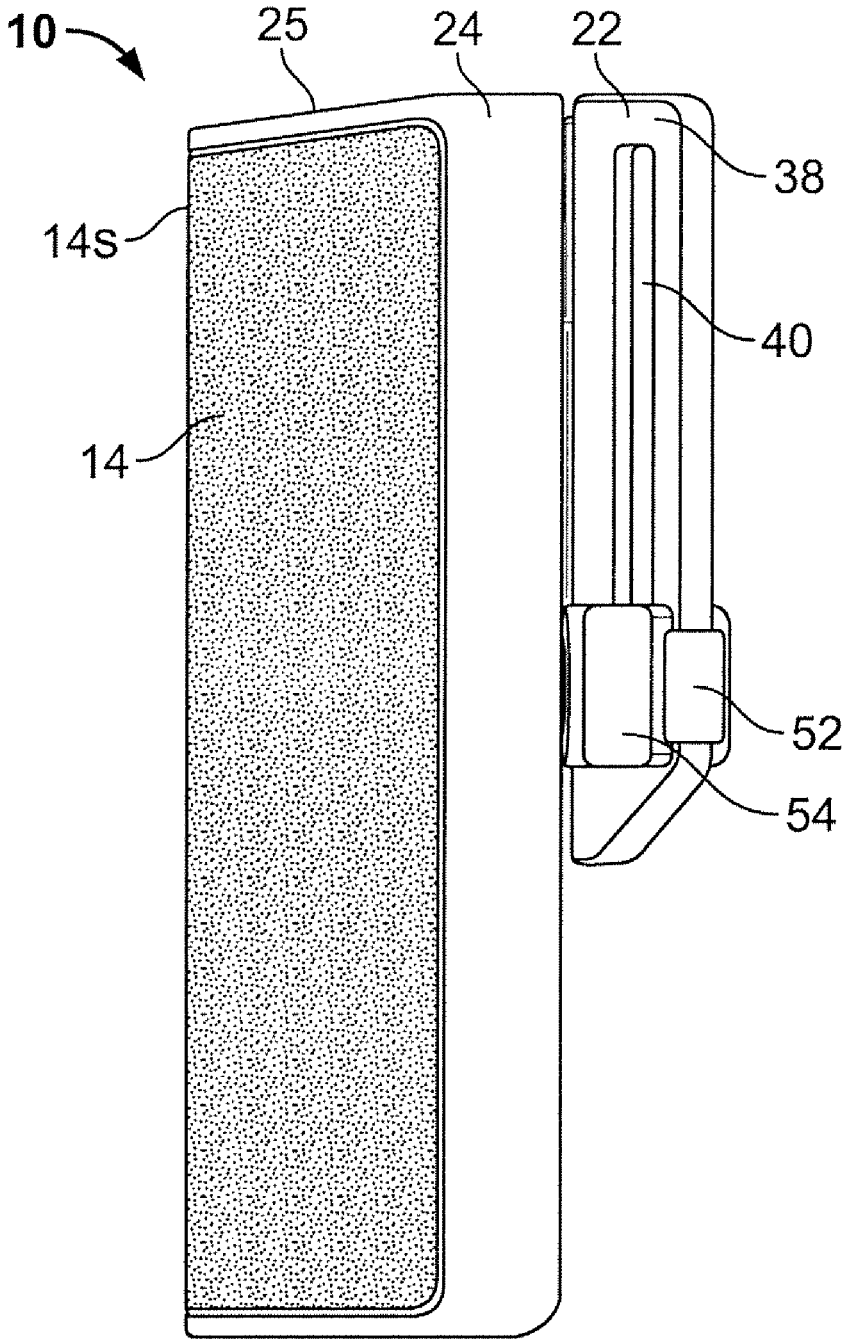
FIG. 6 is a side elevational view of a baton carrier and attachment means made in accordance with the teachings of the present invention.

In the illustrative embodiment, the cylindrical wall 24 of baton holder 14 has a longitudinal slit or opening 14*s* (see FIGS. 1, 2, 3 and 7). The slit 14*s* runs the entire longitudinal length of the cylindrical wall 24. The open top 25 of the cylindrical wall 24 is slanted (FIG. 6) such that the top 25 is lowest by the longitudinal slit 14*s* and is highest toward the attachment member 22.

Figure 7:
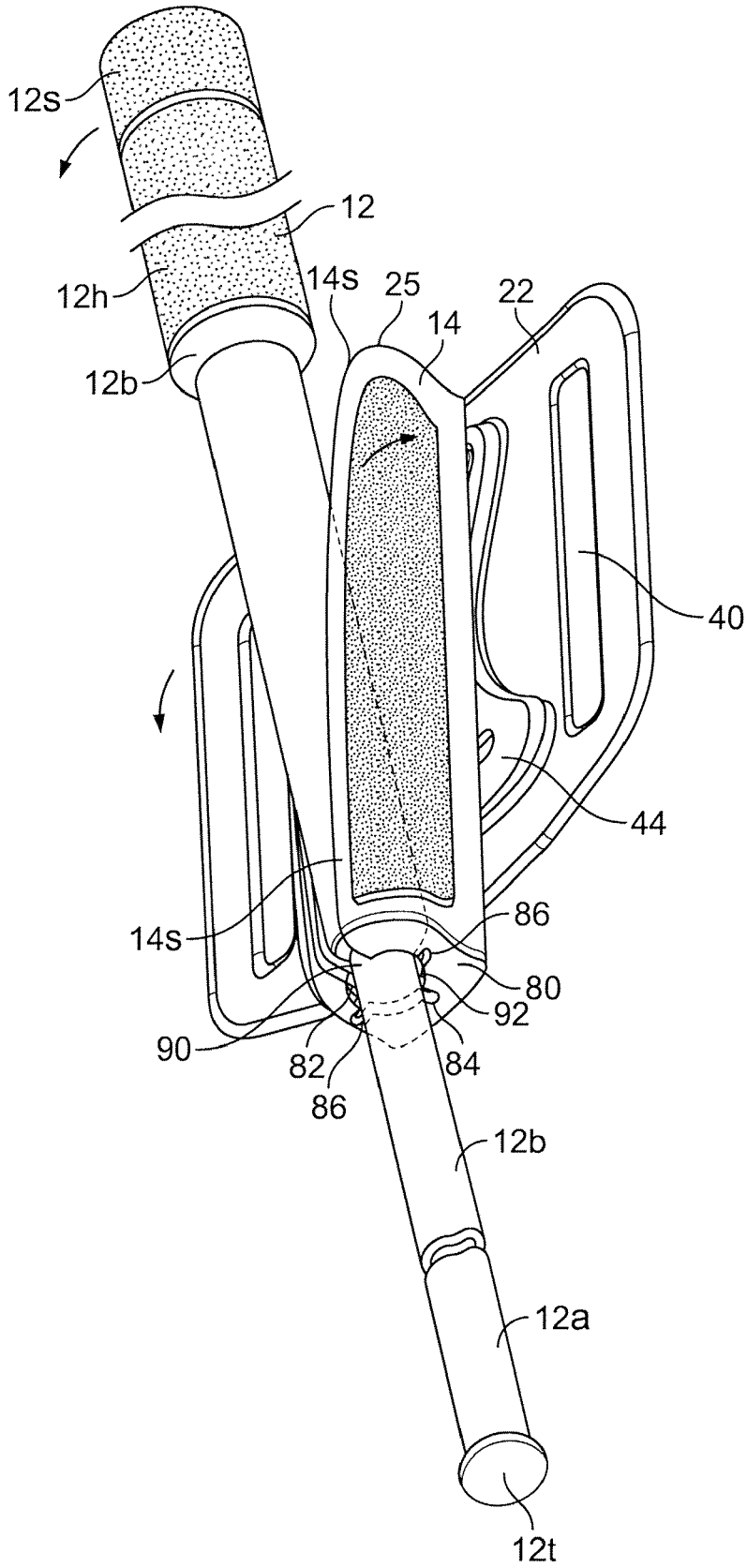
FIG. 7 is a perspective view of a baton carrier of the present invention in use with one type of baton that can be carried therein.

The baton holder 14 also has a partially closed bottom 80 (FIG. 7) with a through hole 82. Referring to FIG. 7, the bottom 82 also has a plurality of slits 84, 86, 88 and 90. Slits 84, 86 and 88 extend radially from the hole 30 toward the cylindrical wall 24. Slit 90 extends from the hole 82 into the longitudinal slit 14*s* in the cylindrical wall 24 to define a continuous opening along the length of the longitudinal slit 14*s* and the bottom slit 90. Raised ribs or curbs 92 are located on the bottom 30 adjacent to each slit 84, 86, 88 and 90 and project upwardly into the baton chamber. The ribs supply additional strength to the bottom 30. The ribs 92 slope downwardly from the wall 24 of the cylinder toward the center of the hole 82. This provides a sloped seating surface for seating the baton in alignment with the axis of the chamber.

The bottom 80 is designed such that the hole 82 of a diameter slightly smaller than the maximum diameter of the baton tip 12*t*, assuring that the baton as retracted does not extend through the bottom of the carrier. Thus, the retracted baton 12 is fully supported by the bottom 80 of the carrier. It is desirable to provide a slight radius on the upper circumferential lip of the hole 82 to assure proper seating of the baton tip 12*t* in the hole.

The radial slits 84, 86, 88 and 90 permit the hole to be selectively expanded. Once the baton is expanded (see FIG. 7) the tip 12*t* can be forced through the expandable hole 82, as well as the telescoping shafts 12*a* and 12*b*. An expanded baton 12 can be pushed down against the ribs 92 to push out the cylindrical wall 24 and expand the hole 82 along the radial slits in the bottom 80 so that the innermost shaft 12*a* of the baton 12 can pass through the hole 82. After the tip 12*t*, located at the end of the innermost shaft 12*a* passes through the hole 82, the cylindrical wall 24 generally springs back to its original position because the diameter of the hole 82 is typically larger than the diameter of the innermost shaft 12*a* of the baton 12.

Further, the hole 82 is preferably sized so that the middle shaft 12*b* of the baton 12 can be passed through the hole 82 so that the base 12*b* of the handle 12*h* of the baton 12 abuts the ribs 92 in the same manner as when the baton is fully retracted. Preferably, the middle shaft 12*b* of the baton 12 includes a tapered outer end that assists in spreading the hole 82 to accommodate the middle shaft 12*b* of the expanded baton for proper seating or holstering of the expanded baton.

When a baton 12 is carried in the carrier 10, the baton 12 can be drawn by gripping the baton handle 12*h*, pulling the baton 12 axially upward, and once the handle has cleared the top 25 of the cylinder, then moving the baton 12 through the longitudinal slit 14*s* in the cylindrical wall 24 of the holder 14, as depicted in FIG. 7. Of course, the expanded baton can also be fully axially withdrawn. Therefore, the initial drawing action for withdrawing both the retracted or the expanded baton from the carrier is an axial motion to free the handle 12*h* from the carrier. It has been found that the subsequent lateral or radial motion to free the telescoped sections 12*a* and 12*b* is a natural movement, making the carrier easy to adapt to and use. It should be noted that the middle 12*b* and the innermost 12*a* shafts of the baton 12 can be forced through the slit 14*s* primarily because the walls 24 of the holder 14 spread apart when sideways pressure is applied. The shafts of the baton are metal and can slide through the slit 14*s* when the walls 24 spread apart. The handle 12*h*, on the other hand, is of sufficient diameter that it is beyond the range of spread of the slit 14*s*. In addition, the handle is generally provided with a friction grip surface such as a foam sleeve 12*s*, or the like, further restricting the radial motion of the handle 12*h* through the slit.

It is preferred that the baton carrier can be of molded plastic (e.g. Delrin or the Mike) having a thickness of 40 to 80 mils.

Note that the slanted top 25 of the cylindrical wall 24 extends to the longitudinal slit 14*s* where radiused corners 27 and 29 are formed (see FIG. 2). Both the slanted top 25 and the rounded corners 27 and 29 facilitate easy removal of an expanded baton 12 through the longitudinal slit 14*s*.

The above described construction provides a practical way to store and access an expandable baton 12 whether the baton 12 is retracted or expanded. It is important to emphasize that the manner of drawing an expanded baton 12 is similar to the manner of drawing a retracted baton 12. If the baton 12 is retracted, the user can easily pull the baton 12 up and out of the holder 16. If the baton 12 is expanded, the baton 12 can be drawn by pulling the baton 12 up and sliding the baton 12 through the longitudinal slit 14*s*.

In another embodiment of the present invention, as shown in FIG. 8, a Federal baton carrier 100 is attached to a belt receiving structure 122, having similar elements to those shown with respect to receiving structure 22. The Federal baton carrier 100 comprises a generally cylindrical outer wall 124 forming an interior chamber or passage 130 in which a baton is placed. The top 102 of the carrier 100 is slanted to permit the easier placement and removal of the baton from and into the carrier. A tab 104 is included to prevent the tip of the baton from extending from below the bottom 106 of the baton carrier when the baton is in a first retracted position, and to keep the baton from slipping out from the carrier 100 when the baton is in a second open position and the tip of the baton extends from the carrier 100.

It will be understood that while the device of the present invention has been shown and explained as being formed generally of plastics, it will be understood that a variety of materials, including metals including high-tech metals and hybrid manufactured metals, wood products, epoxies, plastic-type products, and other structurally significant materials, without departing from the novel scope of the present invention.

Specific embodiments of a baton scabbard have been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed is:

1. A baton carrier for use in combination with an expandable baton, the baton carrier adapted for holding an expendable baton in both an open, extended and a closed, retracted condition when the holder is secured to a user's person, the baton of the telescoping type with an enlarged handle for nesting axially aligned, successively smaller telescoping sections, the baton carrier comprising:

a baton holder having an elongated interior chamber for engaging and holding the handle of the expandable baton substantially along a longitudinal axis of the interior chamber, a top and a bottom;

a belt engagement structure, removably attachable to the baton holder, for securing the baton holder on the belt of a user; and, an adjustable attachment assembly, defined in the belt engagement structure, comprising at least two fastener attachment means each providing a plurality of openings through which a fastener may be passed through and secured to the baton holder such that the baton holder may be fixed and released into desirable positions at a plurality of angles with respect to the belt engagement structure.

2. The baton carrier of claim 1, wherein the attachment assembly is fixedly adjustable to one or more desired positions.

3. The baton carrier of claim 2, wherein the fasteners are screws for fixing the attachment means in an adjusted position.

4. The baton carrier of claim 3, wherein the screws each have a head and a shaft and wherein a hexagonal-type drive opening is created such that the opening advances from the head of the screw through to the interior of the shaft.

5. The baton carrier of claim 1, wherein the attachment assembly is curved to accommodate the curve of the waist of the user.

6. The baton carrier of claim 1, wherein the attachment assembly includes means allowing the assembly to fit belts of varying widths.

7. The baton carrier of claim 6, wherein the means to fit belts of varying widths are positioning bars on a slider.

8. The baton carrier of claim 6, wherein the attachment assembly includes one or more belt openings and one positioning bar in each opening, the positioning bar being adjustable so as to hold the assembly in position on a belt.

9. The baton carrier of claim 8, wherein the positioning bar is positioned and adjustable using a fastener therewithin.

10. The baton carrier of claim 9, wherein the fastener is a screw having a head and a shaft and wherein a hexagonal-type drive opening is created such that the opening advances from the head of the fastener through to the interior of the shaft.

11. A baton carrier for use in combination with an expandable baton, the baton carrier adapted for holding an expandable baton in both an open, extended and a closed, retracted condition when the holder is secured to a user's person, the baton of the telescoping type with an enlarged handle for nesting axially aligned, successively smaller telescoping sections, the baton carrier comprising:

a baton holder having an elongated interior chamber for engaging and holding the handle of the expandable baton substantially along a longitudinal axis of the interior chamber and a bottom;

at least one tab, in the bottom, in a plane substantially perpendicular to the longitudinal axis of the interior chamber, the tab supporting the outer tip of the baton when the baton is seated in the holder and the baton is in a retracted position;

a belt engagement structure, removably attachable to the baton holder, for securing the baton holder on the belt of a user; and an adjustable attachment assembly defined in the belt engagement structure, comprising at least two fastener attachment means each providing a plurality of openings through which a fastener may be passed through and secured to the baton holder such that the baton holder may be fixed and released into desirable positions at a plurality of angles with respect to the belt engagement structure.

12. The baton carrier of claim 11, wherein the attachment means are screws for fixing the attachment means in an adjusted position.

13. The baton carrier of claim 12, wherein the screws comprise a head and a shaft and wherein a hexagonal-type drive opening is created such that the opening advances from the head of the fastener through to the interior of the shaft.

14. The baton carrier of claim 11, wherein the attachment assembly includes means allowing the assembly to fit belts of varying widths.

15. The baton carrier of claim 14, wherein the means to fit belts of varying widths are position bars on sliders.

16. The baton carrier of claim 14, wherein the attachment assembly includes one or more belt openings and one positioning bar in each opening, the positioning bar being adjustable so as to hold the assembly in position on a belt.

17. The baton carrier of claim 16, wherein each positioning bar is positioned and adjustable using a fastener therewithin.

18. The baton carrier of claim 17, wherein the fastener is a screw having a head and a shaft and wherein a hexagonal-type drive opening is created such that the opening advances from the head of the fastener through to the interior of the shaft.

19. The baton carrier of claim 18, wherein the screw has a low-profile head having a wide diameter.

20. The baton carrier of claim 11, wherein the attachment assembly includes a tapered plane that causes the baton holder to be angled such that in use the top of the baton carrier is angled towards the user's body.

21. A method of adjusting a baton carrier to accommodate a particular user, comprising the steps of:

providing a baton holder having a back comprising fastener engagement means and means to engage and hold a baton;

providing a belt engagement structure, removably attachable to the baton holder at the fastener engagement means, for securing the baton carrier on the belt of a user;

providing an adjustable attachment assembly, defined in the belt engagement structure, comprising at least two fastener attachment means each providing a plurality of openings through which a fastener may be passed through and secured to the baton holder at the fastener engagement means;

providing at least two fasteners initially attached within the fastener attachment means of the belt engagement structure and to the fastener engagement means of the baton holder;

releasing the at least two fasteners such that the baton holder is separated from the belt engagement structure;

rotating the belt engagement structure relative to the baton holder and positioning cooperative openings of the plurality of openings of each of the at least two fastener attachment means in proximity to the fastener engagement means of the baton holder; and attaching one of the at least two fasteners through each of the cooperative openings of the belt engagement structure and into the fastener attachment means of the baton holder.

22. The method of adjusting a baton holder of claim 21, wherein the fasteners are screws for fixing the attachment means in an adjusted position.

23. The method of adjusting a baton holder of claim 22, including further adjustment means permitting some smaller adjustments of the fastener attachment means without the complete removal of the screws.

24. The method of adjusting a baton carrier of claim 22, wherein the screws comprise a head and a shaft and wherein a hexagonal-type drive opening is created such that the opening advances from the head of the fastener through to the interior of the shaft.

25. The method of adjusting a baton carrier of claim 22, including the step of providing one or more spaced apart belt openings and one positioning bar in each opening, sliding a belt into the adjusted baton holder through the spaced apart openings and moving the position bars so as to hold the belt within the baton holder.

26. The method of adjusting a baton carrier of claim 24, wherein each positioning bar is positioned and adjustable using a fastener therewithin.

* * * * *